US008678536B2

(12) United States Patent
Toya et al.

(10) Patent No.: US 8,678,536 B2
(45) Date of Patent: Mar. 25, 2014

(54) PRINTING DEVICE AND PRINTING METHOD

(71) Applicant: Seiko Epson Corporation, Tokyo (JP)

(72) Inventors: Akihiro Toya, Nagano (JP); Kazuaki Sakurada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/850,382

(22) Filed: Mar. 26, 2013

(65) Prior Publication Data

US 2013/0257942 A1 Oct. 3, 2013

(30) Foreign Application Priority Data

Mar. 29, 2012 (JP) ..... 2012-077375

(51) Int. Cl.
*B41J 2/205* (2006.01)

(52) U.S. Cl.
USPC ..... 347/15; 347/102

(58) Field of Classification Search
USPC ..... 347/12, 15, 43, 102; 358/1.2, 1.9
See application file for complete search history.

(56) References Cited

U.S. PATENT DOCUMENTS 7,543,903 B2 * 6/2009 Little ..... 347/19
7,794,077 B2 * 9/2010 Falser et al. ..... 347/104
8,599,436 B2 * 12/2013 Sano et al. ..... 358/1.9

FOREIGN PATENT DOCUMENTS

JP 2005-246908 A 9/2005

* cited by examiner

*Primary Examiner* — Lamson Nguyen
(74) *Attorney, Agent, or Firm* — Global IP Counselors, LLP

(57) ABSTRACT

A printing device has a support and heating unit for supporting and heating a medium, a head for discharging color image ink and background image ink on the medium supported by the support and heating unit, and a controller. The controller is configured to perform a color image printing process for executing a plurality of color image recording passes by which the head is moved relative to the medium in a moving direction, and a background image printing process. The controller is configured to execute a wait process of evacuating the head from above the support and heating unit and moving it to an evacuation position to have the head wait at the evacuation position for at least one of between the color image recording passes and between the background image recording passes.

7 Claims, 8 Drawing Sheets

| | Wait between Passes | | Wait between Layers |
|---|---|---|---|
| | Background Image Recording Pass | Color Image Recording Pass | |
| Surface Printing | $T_3$ | $T_1$ | $T_5$ |
| Back Surface Printing | $T_2$ | $T_1$ | $T_4$ |

$(T_1<T_2<T_3<T_4<T_5)$

PRINTING DEVICE AND PRINTING METHOD

CROSS-REFERENCE TO RELATED APPLICATIONS

This application claims the benefit of Japanese Patent Application 2012-077375, filed on Mar. 29, 2012, which is hereby incorporated by reference herein in its entirety.

BACKGROUND

1. Technical Field

The present invention relates to a printing device and a printing method.

2. Related Art

Printing devices having a head for discharging ink onto a medium are already well known. Inkjet printers are one example of this printing device (for example, Japanese Laid-Open Patent Application Publication No. 2005-246908). Also, among this kind of printing device, there are items equipped with a platen for supporting and heating the medium in order to dry the ink discharged onto the medium.

SUMMARY

However, with the aforementioned printing devices, there are cases when color image printing for printing a color image as well as background image printing for printing a background image such as a white image or the like to be the background for that color image are performed.

Specifically, a color image printing process for printing a color image on the medium by executing a plurality of times a color image recording pass with which the head is made to discharge color image ink while the head is moved relative to the medium in the movement direction, changing the relative position of the head to the medium in the intersecting direction that intersects with the movement direction, and a background image printing process for printing a background image on the medium by executing a plurality of times a background image recording pass with which the head is made to discharge background image ink while the head is moved relative to the medium in the movement direction, changing the relative position of the head to the medium in the intersecting direction that intersects with the movement direction are performed.

However, when forming an image by executing this color image printing process and background image printing process, there were cases when the quality of that image was degraded.

The present invention was created considering this problem, and an object is to inhibit degradation of the quality of the image.

A printing device according to one aspect includes a support and heating unit, a head and a controller. The support and heating unit is configured and arranged to support and heat a medium. The head is configured and arranged to discharge color image ink and background image ink on the medium supported by the support and heating unit. The controller is configured to perform a color image printing process, a background image printing process, and a wait process. The color image printing process is a process for printing a color image on the medium by executing a plurality color image recording passes with which the head is made to discharge the color image ink while the head is moved relative to the medium in a movement direction. The color image recording passes are executed with different relative positions of the head with respect to the medium in an intersecting direction that intersects with the movement direction. The background image printing process is a process for printing a background image that is a background for the color image on the medium by executing a plurality of background image recording passes with which the head is made to discharge the background image ink while the head is moved relative to the medium in the movement direction. The background image recording passes are executed with different relative positions of the head with respect to the medium in the intersecting direction that intersects with the movement direction. The wait process is a process of evacuating the head from above the support and heating unit and moving the head to an evacuation position to have the head wait at the evacuation position during at least one of between the color image recording passes and between the background image recording passes.

Other features of the present invention will become clearer from the descriptions in this specification and the attached drawings.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
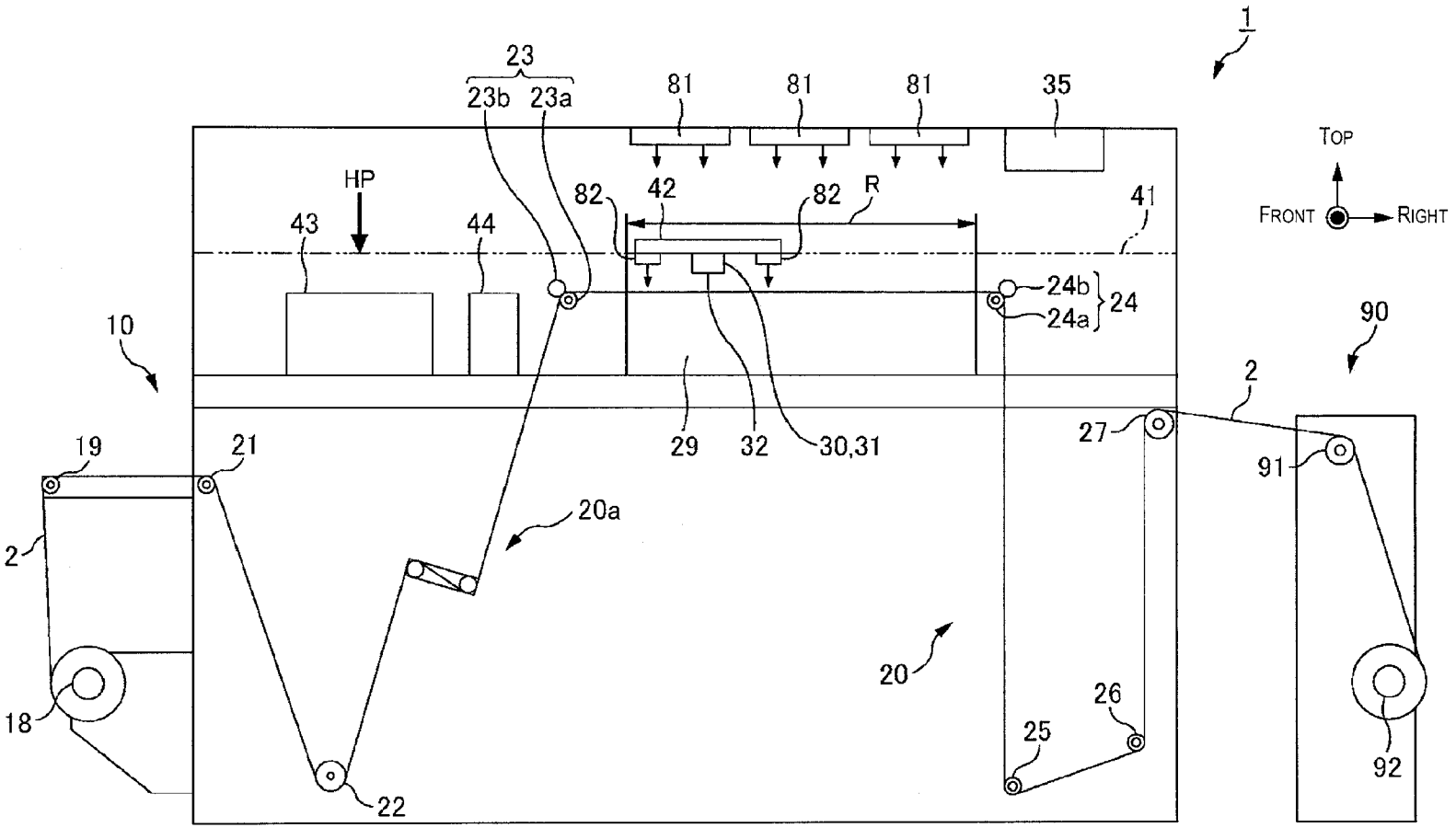
FIG. 1 is a schematic drawing showing the constitution of an image recording device 1.

At least the following points will become clearer from the descriptions in this specification and the attached drawings.

A printing device according to one embodiment includes a support and heating unit, a head and a controller. The support and heating unit is configured and arranged to support and heat a medium. The head is configured and arranged to discharge color image ink and background image ink on the medium supported by the support and heating unit. The controller is configured to perform a color image printing process, a background image printing process, and a wait process. The color image printing process is a process for printing a color image on the medium by executing a plurality color image recording passes with which the head is made to discharge the color image ink while the head is moved relative to the medium in a movement direction. The color image recording passes are executed with different relative positions of the head with respect to the medium in an intersecting direction that intersects with the movement direction. The background image printing process is a process for printing a background image that is a background for the color image on the medium by executing a plurality of background image recording passes with which the head is made to discharge the background image ink while the head is moved relative to the medium in the movement direction. The background image recording passes are executed with different relative positions of the head with respect to the medium in the intersecting direction that intersects with the movement direction. The wait process is a process of evacuating the head from above the support and heating unit and moving the head to an evacuation position to have the head wait at the evacuation position during at least one of between the color image recording passes and between the background image recording passes.

With this printing device, it is possible to inhibit degradation of the quality of the image.

It is also possible to be equipped with an air blower configured and arranged to blow air toward the medium. When executing the color image recording passes and the background image recording passes, the controller is preferably configured to control the air blower to blow air toward the medium, and when executing the wait process, the controller is preferably further configured to control the air blower so that the air is blown at a faster speed than a speed when executing the color image recording passes and the background image recording passes.

In this case, it is possible to suitably inhibit degradation of the quality of the image.

It is also possible to be equipped with a carriage supporting the head, and configured and arranged to move along with a movement of the head, and a moving air blower provided on the carriage, and configured and arranged to blow air toward the medium while moving along with the movement of the head. The air blower is preferably a fixed air blower fixed to a printing device main unit. When executing the color image recording passes and the background image recording passes, the controller is preferably configured to control the fixed air blower and the moving air blower to blow air toward the medium, and when executing the wait process, the controller is preferably further configured to control the fixed air blower so that the air is blown at a faster speed than a speed when executing the color image recording passes and the background image recording passes, and to stop blowing of the air from the moving air blower.

In this case, it is possible to save power.

It is also possible to arrange the controller to execute the wait process only between the background image recording passes.

In this case, it is possible to improve the printing speed while inhibiting degradation of the quality of the image.

It is also possible to arrange the controller to execute the wait process both between the color image recording passes and between the background image recording passes such that a wait time for which the head is made to wait is longer between the background image recording passes than between the color image recording passes.

In this case, it is possible to improve the printing speed while inhibiting degradation of the quality of the image.

It is also possible to arranged the controller to selectively execute a surface printing process in which the background image printing process is performed, and the color image printing process is performed subsequent to the background image printing process, and a back surface printing process in which the color image printing process is performed, and the background image printing process is performed subsequent to the color image printing process, and execute the wait process both between the background image recording passes with the surface printing process and between the background image recording passes with the back surface printing process so that a wait time for which the head is made to wait is longer between the background image recording passes with the surface printing process than between the background image recording passes with the back surface printing process.

In this case, it is possible to improve the printing speed while inhibiting the degradation of the quality of the image.

A printing method according to one embodiment includes: printing a color image on a medium by executing a plurality color image recording passes with which a head is made to discharge color image ink and background image ink on a medium supported and heated by a support and heating unit while the head is moved relative to the medium in a movement direction, the color image recording passes being executed with different relative positions of the head with respect to the medium in an intersecting direction that intersects with the movement direction; printing a background image that is a background for the color image on the medium by executing a plurality background image recording passes with which the head is made to discharge background image ink while the head is moved relative to the medium in the movement direction, the background image recording passes being executed with different relative positions of the head with respect to the medium in the intersecting direction that intersects with the movement direction; and executing a wait process in which the head is evacuated from above the support and heating unit and moved to an evacuation position so that the head is made to wait at the evacuation position at least one of between the color image recording passes and between the background image recording passes.

With this printing method, it is possible to inhibit degradation of the quality of the image.

Configuration Example of Image Recording Device 1

Figure 2:
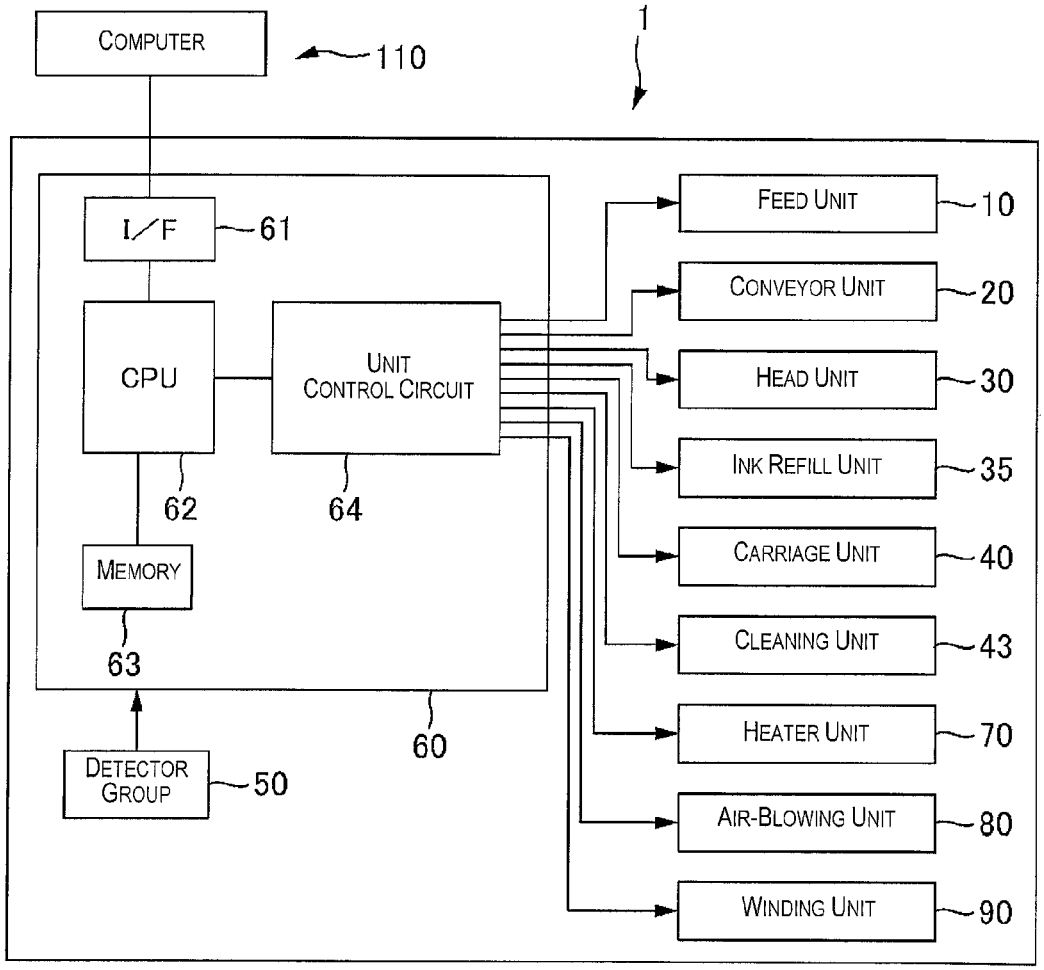
FIG. 2 is a block diagram showing the constitution of the image recording device 1.

We will use FIG. 1 and FIG. 2 to describe a configuration example of the image recording device 1 as an example of the printing device (with this embodiment, an inkjet printer, and particularly, a lateral scan type label printing apparatus). FIG. 1 is a schematic cross section view of the image recording device 1, and FIG. 2 is a block diagram of the image recording device 1.

With the description below, when using the terms "vertical direction" and "horizontal direction," these indicate items with the directions shown by the arrows in FIG. 1 as the reference. Also, when using the term "front-back direction," this indicates an item with the direction orthogonal to the paper surface in FIG. 1.

Also, with this embodiment, as an example of the medium on which the image recording device 1 records an image, we will give a description using a transparent media rolled into a roll form (hereafter referred to as rolled transparent media 2).

As shown in FIG. 1 and FIG. 2, the image recording device 1 of this embodiment has a conveyor unit 20, a head unit 30 which has a feed unit 10, a platen 29, and a winding unit 90 along a conveyance path on which the conveyor unit 20 conveys the rolled transparent media 2 (in FIG. 1, represented by the part at which the rolled transparent media 2 is positioned from a rolled transparent media winding shaft 18 up to a rolled transparent media winding drive shaft 92) and furthermore, performs image recording by discharging a plurality of types of ink in an image recording area R on the conveyance path, an ink refill unit 35, a carriage unit 40, a cleaning unit 43, a heater unit 70, an air-blowing unit 80 that blows air to the rolled transparent media 2 on the platen 29, a controller 60 that controls these units and the like and manages their operation as the image recording device 1, and a detector group 50.

The feed unit 10 feeds the rolled transparent media 2 to the conveyor unit 20. This feed unit 10 has the rolled transparent media winding shaft 18 on which the rolled transparent media 2 is wound and which is supported to be able to rotate, and a relay roller 19 for winding the rolled transparent media 2 let out from the rolled transparent media winding shaft 18 and leading it the conveyor unit 20.

The conveyor unit 20 conveys the rolled transparent media 2 sent from the feed unit 10 along a preset conveyance path. As shown in FIG. 1, this conveyor unit 20 has a relay roller 21 positioned horizontally to the right in relation to the relay roller 19, a relay roller 22 positioned diagonally downward to the right seen from the relay roller 21, a first conveyor roller 23 positioned diagonally upward to the right seen from the relay roller 22 (left side in the conveyance direction seen from the platen 29), a steering unit (navigation unit) 20*a* positioned between the relay roller 22 and the first conveyor roller 23, a second conveyor roller 24 positioned to the right seen from the first conveyor roller 23 (right side in the conveyance direction seen from the platen 29), a reverse roller 25 positioned vertically downward seen from the second conveyor roller 24, a relay roller 26 positioned to the right seen from the reverse roller 25, and a delivery roller 27 positioned upward seen from the relay roller 26.

The relay roller 21 is a roller that winds the rolled transparent media 2 sent from the relay roller 19 from the left and slackens it facing downward.

The relay roller 22 is a roller that winds the rolled transparent media 2 sent from the relay roller 21 from the left and conveys it diagonally upward to the right.

The first conveyor roller 23 has a first drive roller 23*a* driven by a motor (not illustrated), and a first driven roller 23*b* arranged so as to sandwich the rolled transparent media 2 and face opposite that first drive roller 23*a*. This first conveyor roller 23 is a roller that pulls the downwardly slackened rolled transparent media 2 upward, and conveys it to the image recording area R facing opposite the platen 29. The first conveyor roller 23 temporarily stops conveying during the time that image printing is being implemented on a site of the rolled transparent media 2 on the image recording area R (specifically, as described later, one page of image recording is achieved at that site by the head 31 discharging ink at that site of the stopped rolled transparent media 2 while moving in the horizontal direction and the front-back direction). Through drive control by the controller 60, by the first driven roller 23*b* rotating in accordance with the rotational drive of the first drive roller 23*a*, the conveyance volume of the rolled transparent media 2 positioned on the platen 29 is adjusted.

As described above, the conveyor unit 20 has a mechanism that slackens downward the site of the rolled transparent media 2 wound between the relay rollers 21 and 22 and the first conveyor roller 23 and conveys it. This slacking of the rolled transparent media 2 is monitored by the controller 60 based on detection signals from a slack detection sensor (not illustrated). In specific terms, when a site of the rolled transparent media 2 slackened between the relay roller 21 and 22 and the first conveyor roller 23 is detected by the slack detection sensor, a suitable level of tensile force is given to that site, so the conveyor unit 20 is able to convey the rolled transparent media 2 in a slackened state. Meanwhile, when a slackened site of the rolled transparent media 2 is not detected by the slack detection sensor, excessively large tensile force is given to that site, so conveying of the rolled transparent media 2 by the conveyor unit 20 is temporarily stopped, and the tensile force is adjusted to a suitable level.

As shown in FIG. 1, the steering unit 20*a* is positioned on the conveyance path in a tilted state, and is for changing the width direction position of the rolled transparent media 2 (the position at which the rolled transparent media 2 is positioned in the width direction (front-back direction shown in FIG. 1)) by rotating. Specifically, when the rolled transparent media 2 is conveyed along the conveyance path, there are cases when the width direction position of the rolled transparent media 2 is displaced due to things such as axial skew, attachment error or the like of the relay roller or the like, or variation in the tensile strength that acts on the rolled transparent media 2. Then, that steering unit 20*a* is for adjusting that width direction position of the rolled transparent media 2.

The second conveyor roller 24 has a second driver roller 24*a* driven by a motor (not illustrated), and a second driven roller 24*b* arranged so as to sandwich the rolled transparent media 2 facing opposite that second drive roller 24*a*. This second conveyor roller 24 is a roller that conveys a site of the rolled transparent media 2 after the image is recorded by the head unit 30 vertically downward after being conveyed in the horizontally right direction along the support surface of the platen 29. By doing this, the direction of the rolled transparent media 2 is changed. The second driven roller 24*b* rotates along with the rotational drive of the second drive roller 24*a* by the drive control of the controller 60, and the designated tensile force given to the site of the rolled transparent media 2 positioned on the platen 29 is adjusted.

The reverse roller 25 is a roller that winds the rolled transparent media 2 sent from the second conveyor roller 24 from the upper left side and conveys it diagonally right and upward.

The relay roller 26 is a roller that winds the rolled transparent media 2 sent from the reverse roller 25 from the lower left side and conveys it upward.

The delivery roller 27 winds the rolled transparent media 2 sent from the relay roller 26 from the lower left side and sends it to the winding unit 90.

In this way, the conveyance path for conveying the rolled transparent media 2 is formed by moving the rolled transparent media 2 in sequence via each roller. The rolled transparent media 2 is transported along that conveyance path intermittently in area units corresponding to the image recording area R (specifically, the conveyance is performed intermittently for each one page of image recording at a site of the rolled transparent media 2 on the image recording area R).

The head unit 30 is for recording an image on the site of the rolled transparent media 2 positioned at the image recording area R on the conveyance path. Specifically, the head unit 30 discharges ink from the ink discharge nozzles and forms an image on the site of the rolled transparent media 2 sent by the conveyor unit 20 to the image recording area R on the conveyance path (on the platen 29). This head unit 30 has a head 31.

The head 31 has on its bottom surface (specifically, the nozzle surface 32) an ink discharge nozzle row in which are aligned discharge nozzles in the row direction. With this embodiment, for each color yellow (Y), magenta (M), cyan (C), black (K), and white (W), there is an ink discharge nozzle row consisting of a plurality of ink discharge nozzles #1 to #N. Each ink discharge nozzle #1 to #N of each ink discharge nozzle row is aligned in a straight line in the intersecting direction that intersects with the conveyance direction of the rolled transparent media 2 (in other words, that intersecting direction is the row direction described previously). Each ink discharge nozzle row is arranged in parallel with a gap opened to each other along the applicable conveyance direction.

On each ink discharge nozzle #1 to #N is provided a piezo element (not illustrated) as a drive element for discharging ink drops. When voltage of a designated duration is applied between electrodes provided at both ends, the piezo element expands according to the voltage application time, and deforms that side wall of the ink flow path. By doing this, the volume of the ink flow path contracts according to the expansion of the piezo element, and the ink correlating to this contraction amount becomes ink drops and is discharged from the ink discharge nozzles #1 to #N of each color.

Also, as described later, the head 31 is made to be able to move back and forth in the conveyance direction (specifically, the horizontal direction) and the row direction (specifically, the front-back direction).

The ink refill unit 35 is for refilling ink in the head 31 when the volume of ink within the head 31 has decreased due to discharging of ink by the head 31.

This ink refill unit 35 is provided for each ink color. Specifically, provided are a yellow ink refill unit for refilling yellow colored ink, a magenta ink refill unit for refilling magenta colored ink, a cyan ink refill unit for refilling cyan colored ink, a black ink refill unit for refilling the black colored ink, and a white ink refill unit for refilling the white colored ink.

The ink refill unit 35 is constituted from a large number of tubes that become the ink flow paths (passages) and a large number of valves and the like for opening and closing those tubes. The locations at which those ink cartridges are arranged are expressed by code number 35 in FIG. 1.

The carriage unit 40 is for moving the head 31. This carriage unit 40 has a carriage guide rail 41 extending in the conveyance direction (horizontal direction) (shown by a double-dot-dashed line in FIG. 1), a carriage 42 supported to be able to move back and forth in the conveyance direction (horizontal direction) along the carriage guide rail 41, and a motor (not illustrated).

The carriage 42 is constituted so as to be an integrated unit with the head 31 and move in the conveyance direction (horizontal direction) by the drive of the motor (not illustrated). Specifically, the carriage 42 supports the head 31 and is made to move along with the movement of the head 31. Also, a head guide rail (not illustrated) is provided extending in the row direction (front-back direction) on the carriage 42, and the head 31 is constituted so as to move in the row direction (front-back direction) along that head guide rail by the driving of the motor.

The cleaning unit 43 is for cleaning the head 31. This cleaning unit 43 is provided at a home position (hereafter referred to as HP, see FIG. 1), and has a cap, a suction pump and the like. When the head 31 (carriage 42) is moved in the conveyance direction (horizontal direction) and positioned at the HP, the cap (not illustrated) is made to seal tightly on the bottom surface of the head 31 (nozzle surface 32). When the suction pump is operated in a state with the cap tightly sealed in this way, the ink within the head 31 is suctioned together with thickened ink and paper dust. Working in this way, cleaning of the head 31 is completed by the clogged ink discharge nozzle recovering from a non-discharge state.

Also, a flushing unit 44 is provided between the HP and the platen 29 in the conveyance direction (horizontal direction), and when the head 31 (carriage 42) moves in the conveyance direction (horizontal direction) and is positioned at a position facing opposite the flushing unit 44, the head 31 executes a flushing operation by which ink is discharged and flushed from each ink discharge nozzle belonging to the ink discharge nozzle row.

The platen 29 is for supporting and heating the rolled transparent media 2. Specifically, the platen 29 supports the site of the rolled transparent media 2 positioned at the image recording area R on the conveyance path and heats that site. As shown in FIG. 1, this platen 29 is provided corresponding to the image recording area R on the conveyance path, and is arranged at an area along the conveyance path between the first conveyor roller 23 and the second conveyor roller 24. Then, the platen 29 is able to heat that site of the rolled transparent media 2 by receiving supply of the heat generated by the heater unit 70.

The heater unit 70 is for heating the rolled transparent media 2, and has a heater (not illustrated). This heater has nichrome wires, and is constituted such that those nichrome wires are arranged inside the platen 29 so as to be a fixed distance from the support surface of the platen 29. Because of that, with the heater, by being made conductive, the nichrome wires themselves are heated, and it is possible to conduct heat to the site of the rolled transparent media 2 positioned above the support surface of the platen 29. This heater is constituted with nichrome wires built into the entire area of the platen 29, so it is possible to evenly conduct heat to the site of the rolled transparent media 2 on the platen 29. With this embodiment, that site of the rolled transparent media 2 is heated evenly such that the temperature of the site of the rolled transparent media 2 on the platen is 45° C. By doing this, it is possible to dry the ink that has impacted that site of the rolled transparent media 2.

The air-blowing unit 80 is for drying the ink discharged on that site by sending air to the site of the rolled transparent media 2 on the platen 29, working in cooperation with the platen 29 (heater unit 70). This air-blowing unit 80 has a ceiling fan 81 as an example of a fixed air blower fixed to the image recording device main unit, and an on-carriage fan 82 as an example of a moving air blower that blows air toward the rolled transparent media 2.

The ceiling fan 81 sends air (ventilates) toward the site of the rolled transparent media 2 on the platen 29 by rotating, and dries the ink impacted on that site. This ceiling fan 81 is an axial flow fan, and as shown in FIG. 1, there are a plurality of them provided on the image recording device main unit (in specific terms, a cover (not illustrated) capable of opening and closing that is provided on the image recording device main unit). Then, as shown in FIG. 1, when the cover is closed, these ceiling fans 81 are positioned above the platen 29, and are made to face opposite the support surface of that platen 29 (the rolled transparent media 2 on that platen 29). Then, the ceiling fan 81 blows air downward in a state facing opposite the platen 29 (the air direction is shown by the arrow attached to the ceiling fan 81 in FIG. 1).

Similar to the ceiling fan 81, the on-carriage fan 82 also sends air (ventilates) toward the site of the rolled transparent media 2 on the platen 29 by rotating, and dries the ink impacted on that site. This on-carriage fan 82 is also an axial flow fan, and a plurality of these are provided on the carriage 42 (with this embodiment, two). Specifically, as shown in FIG. 1, one of the on-carriage fans 82 is equipped further to the left than the head 31 in the conveyance direction, and the other on-carriage fan 82 is equipped further to the right side than the head 31 in the conveyance direction. With this embodiment, the two on-carriage fans 82 operate simultaneously (there is no operation of just one alone).

The on-carriage fan 82 is provided on the carriage 42 together with the head 31, so while moving together with the movement of the head 31 (carriage 42), it blows air toward the rolled transparent media 2 (with regard to this point, it differs from the ceiling fan 81 which does not blow air while moving). With this embodiment, the on-carriage fan 82 is positioned above the platen 29, faces opposite the support surface of that platen 29 (the rolled transparent media 2 of that platen 29), and blows air downward (the air direction is shown by the arrow attached to the on-carriage fan 82 in FIG. 1).

The winding unit 90 is for winding the rolled transparent media 2 sent by the conveyor unit 20 (the rolled transparent media on which an image is already recorded). This winding unit 90 has a relay roller 91 for conveying the rolled transparent media 2 sent from the delivery roller 27 diagonally downward to the right winding from the left side upward, and a rolled transparent media winding drive shaft 92 for winding up the rolled transparent media 2 sent from the relay roller 91 supported to be able to rotate.

The controller 60 is a control unit for performing control of the image recording device 1. As shown in FIG. 2, this controller 60 has an interface unit 61, a CPU 62, a memory 63, and a unit control circuit 64. The interface unit 61 is for performing data sending and receiving between the host computer 110 which is an external device and the image recording device 1. The CPU 62 is an arithmetic processing device for performing overall control of the image recording device 1. The memory 63 is for ensuring the area for storing the programs of the CPU 62, a work area and the like. The CPU 62 controls each unit by a unit control circuit 64 according to the programs stored in the memory 63.

The detector group 50 is for monitoring the status within the image recording device 1, and for example includes the slack detection sensor described above, a rotary encoder attached to the conveyor roller and used for control of conveying of the rolled transparent media 2 and the like, a paper detection sensor for detecting whether or not there is conveyed rolled transparent media 2, a linear encoder for detecting the position in the conveyance direction (horizontal direction) of the carriage 42 (or the head 31), a paper end position detection sensor for detecting the paper end (edge) position in the width direction of the roller transparent media 2, and the like.

Operation Example of Image Recording Device 1

As described above, the head 31 which has an ink discharge nozzle row in which ink discharge nozzles are aligned in the row direction (front-back direction) is provided on the image recording device 1 of this embodiment. Then, one page of image recording is performed on the site of the rolled transparent media 2 on the image recording area R by the controller 60 having that head 31 move in the conveyance direction (horizontal direction), discharging ink from the ink discharge nozzles, and forming raster lines along the conveyance direction (horizontal direction) (this, specifically this operation, is called an image recording pass or simply a pass).

Here, the controller 60 of this embodiment executes printing with a plurality of passes (4 passes, 6 passes, 8 passes or the like). Specifically, to increase the resolution of the image in the row direction, the position of the head 31 is changed a little bit each time in the row direction with each pass to perform printing. Also, as an image forming method, for example, well known interlace (microweave) printing is executed.

Figure 3:
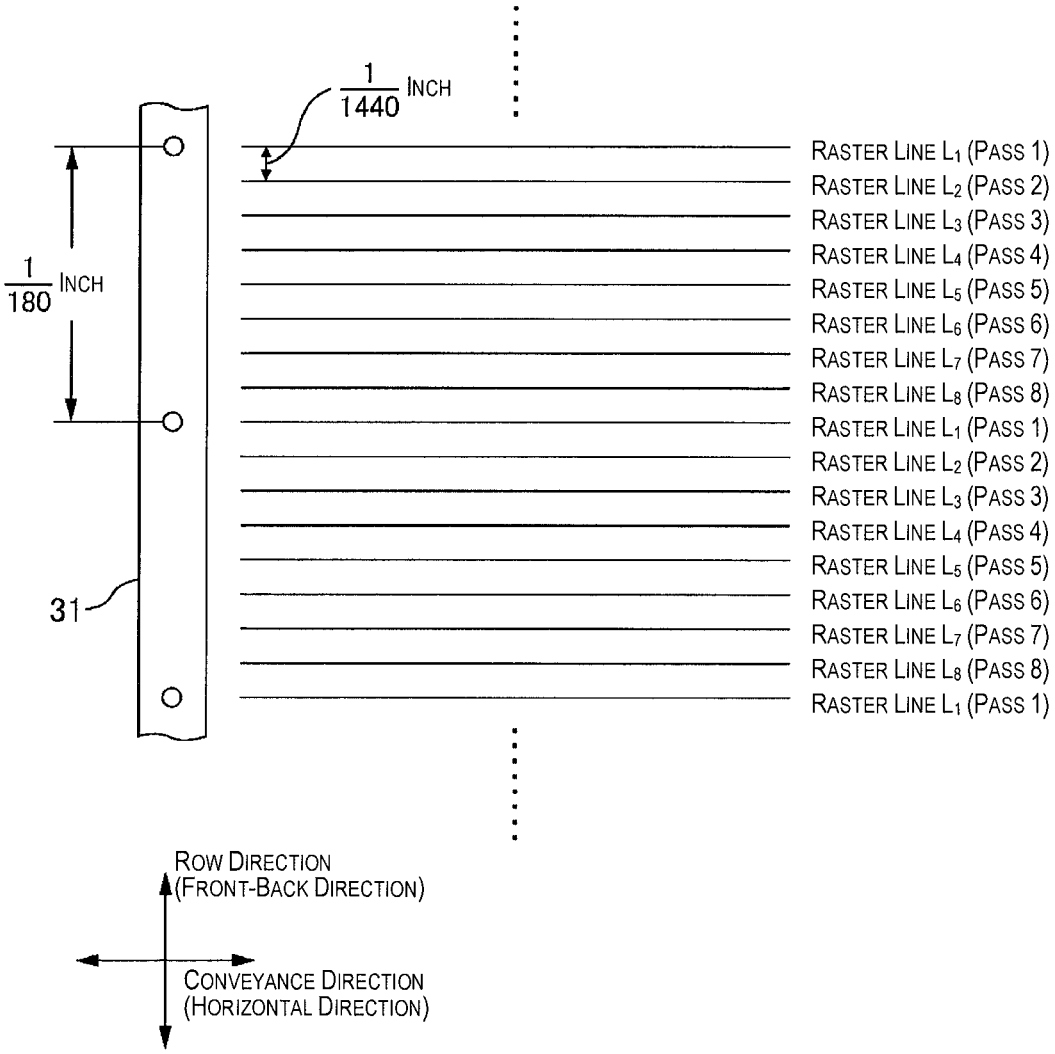
FIG. 3 is a pattern diagram showing the raster lines formed with each pass in a case when printing with 8 passes.

We will describe this in specific terms using FIG. 3. FIG. 3 is a pattern diagram shown the raster lines formed with each pass in a case of printing with 8 passes.

The ink discharge nozzle row (ink discharge nozzles) of the head 31 are represented at the left side in FIG. 3, and by ink being discharged from the ink discharge nozzles while that head 31 (ink discharge nozzle row) is moved in the conveyance direction, raster lines are formed. The position in the row direction of the head 31 (ink discharge nozzle row) represented in the drawing is the position at the time of the first pass, and when the head 31 (ink discharge nozzle row) is moved with that position maintained as is in the conveyance direction, the first pass of printing is executed, and three raster lines represented in the drawing (raster line L1 for which pass 1 is written at the right edge) are formed. In FIG. 3, to make the drawing easier to understand, a straight line raster line with no breaks is represented, but of course, when there is no printing data, break parts could occur in the raster lines.

Next, the head 31 (ink discharge nozzle row) moves in the row direction, and when the head 31 (ink discharge nozzle row) moves in the conveyance direction with the position after moving maintained as is, printing of the second pass is executed, and the two raster lines represented in the drawing (raster lines L2 for which pass 2 is written at the right edge) are formed. Note that because interlace (microweave) printing is being used, the raster lines L2 adjacent to the raster lines L1 are formed with ink discharged from a different ink discharge nozzle than the ink discharge nozzle from which ink was discharged to form the raster lines L1. Because of that, the movement distance in the row direction of the head 31 (ink discharge nozzle row) is not ⅛ of the distance between nozzles (e.g. 1/180 inch) ($1/180 \times 1/8 = 1/1440$ inch), but rather a larger distance than that (hereafter, this distance is referred to as distance d).

Thereafter, printing of the third to eighth passes is executed by performing the same operation, and the remaining raster lines represented in the drawing are formed (raster lines L3 to L8 written as passes 3 to 8 at the right edge). In this way, by forming raster lines with 8 passes, it becomes possible to have resolution that is 8 times the resolution of the image in the row direction (1440÷180).

With this embodiment, so-called bidirectional printing is performed. Specifically, the direction in which the head 31 (ink discharge nozzle row) moves when printing of the first, third, fifth, and seventh passes is performed and the direction in which the head 31 (ink discharge nozzle row) 31 moves when printing of the second, fourth, sixth, and eighth passes is performed are reverse directions to each other.

However, with this embodiment, color image printing with which a color image (here, an image of a label) is printed and background image printing with which a background image which will be the background of that color image is printed are performed. Then, in this case, the previously described one page of image recording (specifically, image recording by executing image recording passes a plurality of times) is implemented twice (specifically, image recording of the color image and image recording of the background image), and the color image layer (hereafter also called a layer) and the background image layer are overlapped.

Hereafter, as an example of the operation of the image recording device 1, we will describe an example of a case of performing the background image printing process which prints a background image by executing background image recording passes 8 times on the rolled transparent media 2, and performing the color image printing process which prints a color image by executing color image recording passes 8 times after the background image printing process on the rolled transparent media 2.

Image Recording Operation Example for Image Recording Device 1

Figure 4:
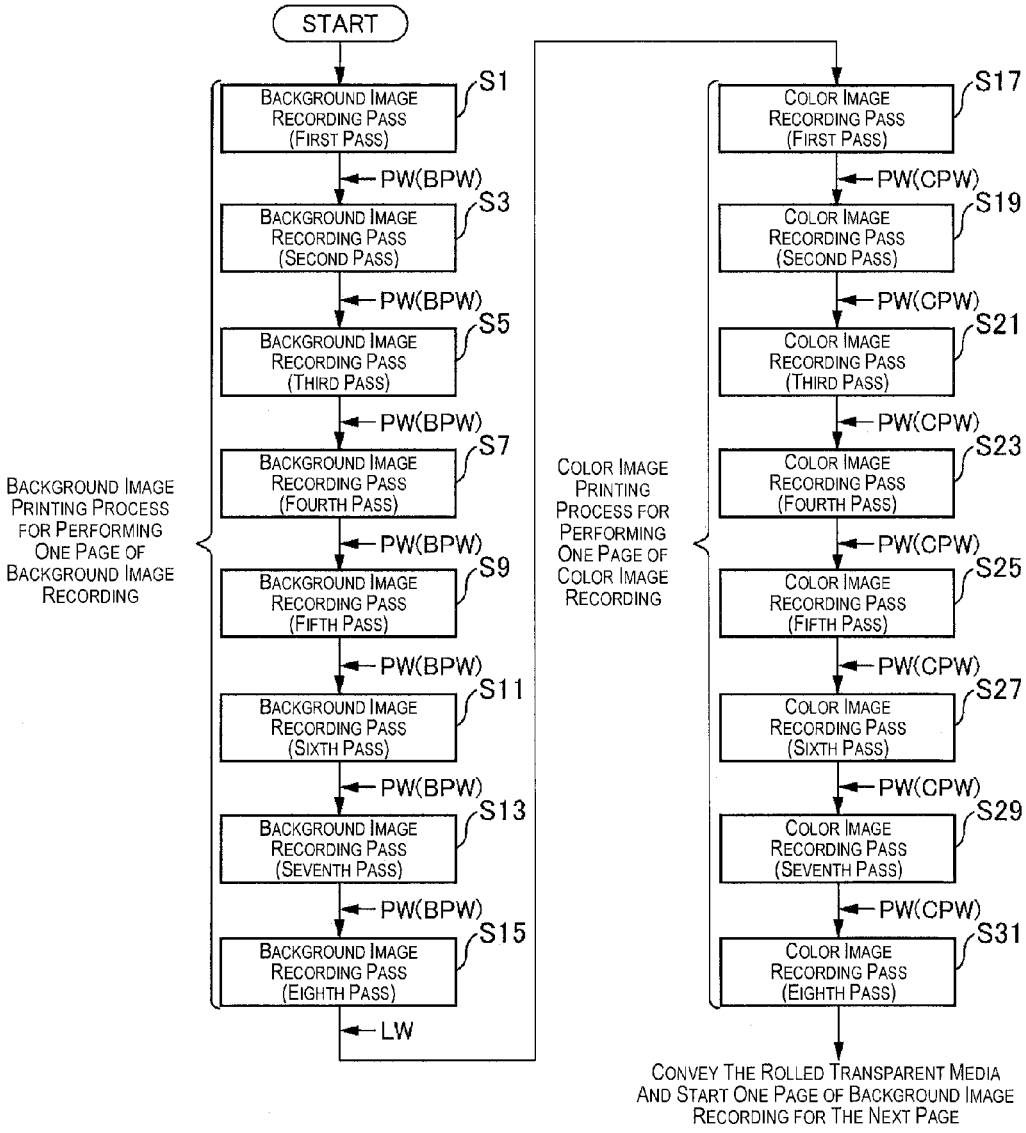
FIG. 4 is an explanatory diagram for describing an example of the image recording operation of the image recording device 1.

Here, we will describe an example of the image recording operation of the image recording device 1 based on the aforementioned case using FIG. 4. FIG. 4 is an explanatory drawing for describing an example of the image recording operation of the image recording device 1. This image recording operation is mainly realized by the controller 60. In particular, with this embodiment, it is realized by the CPU 62 processing the program stored in the memory 63. Also, this program is constituted from a code for performing the various operations described hereafter.

When the rolled transparent media 2 for which the previously described intermittent rolled transparent media 2 conveying was being performed stops, the background image printing process for performing one page of background image recording on the site of the rolled transparent media 2 on the image recording area R is started by the controller 60.

First, the controller 60 executes a first background image recording pass. Specifically, while moving the head 31 in the conveyance direction relative to the rolled transparent media 2 (with this embodiment, moving the head 31 in the conveyance direction), the controller 60 has the head 31 discharge background image ink, and executes the first pass of the background image printing (forming the raster line L1 shown in FIG. 3) (step S1). With this embodiment, a white image (so-called solid white image) is printed as the background image. To do that, white ink is used as the background image ink.

Next, the controller 60 executes the second background image recording pass. Specifically, after moving the head 31 by the distance d in the row direction, the controller 60 has the head 31 discharge white ink while moving the head 31 in the conveyance direction, and executes the second pass of background image printing (forms raster line L2 shown in FIG. 3) (step S3).

Also, by repeatedly performing the same operation as the second background image recording pass 6 times, the third to eighth passes of background image printing (forming raster lines L3 to L8 shown in FIG. 3) are executed by the controller 60 (steps S5, S7, S9, S11, S13, S15).

In this way, the controller 60 executes the background image recording pass by which it has the head 31 discharge background image ink while moving the head 31 in the conveyance direction relative to the rolled transparent media 2 (correlating to the movement direction) a plurality of times (8 times) while changing the relative position of the head 31 in relation to the rolled transparent media 2 in the row direction intersecting with the conveyance direction (correlating to the intersecting direction), to execute the background image printing process by which the background image which is the background of the color image is printed on the rolled transparent media 2. Then, by executing this background image printing process, one page of a solid white image is formed on the rolled transparent media 2.

Next, while maintaining the stopped state of the rolled transparent media 2 from the background image printing process, the color image printing process for performing one page of color image recording (with this embodiment, image recording of a label) on a site of the rolled transparent media 2 on the image recording area R (specifically, the site at which the solid white image is formed) is started by the controller 60.

First, the controller 60 executes the first color image recording pass. Specifically, the controller 60 has the head 31 discharge color image ink while having the head 31 move in the conveyance direction relative to the rolled transparent media 2 (with this embodiment, the head 31 is moved in the conveyance direction) to execute the first pass of color image printing (formation of the raster line L1 shown in FIG. 3) (step S17). With this embodiment, as the color image ink, four colors of ink are used, specifically, yellow ink, magenta ink, cyan ink, and black ink.

Next, the controller 60 executes the second color image recording pass. Specifically, the controller 60 has the head 31 discharge yellow ink, magenta ink, cyan ink, and black ink while moving the head 31 in the conveyance direction after moving the head 31 by the distance d in the row direction to execute the second pass of color image printing (forming rater line L2 shown in FIG. 3) (step S19).

Also, thereafter, by repeatedly performing the same operation as the second color image recording pass 6 times, the third to eighth passes of color image printing (forming raster lines L3 to L8 in FIG. 3) are executed by the controller 60 (steps S21, S23, S25, S27, S29 and S31).

In this way, the controller 60 executes the color image recording pass by which the head 31 is made to discharge the color image ink while moving the head 31 in the conveyance direction (correlates to the movement direction) in relation to the rolled transparent media 2 a plurality of times (8 times) while changing the relative position of the head 31 in relation to the rolled transparent media 2 in the row direction intersecting with the conveyance direction (correlates to the intersecting direction) to execute the color image printing process of printing a color image on the rolled transparent media 2. Also, by executing this color image printing process, one page of a color image (label image) is formed on the rolled transparent media 2. In other words, one page of the color image is overlapped on one page of the background image (solid white image) (the color image layer overlaps the background image layer).

Also, when that color image printing process ends, the controller 60 performs the previously described intermittent conveying of the rolled transparent media 2. Then, subsequent to that conveyance, the background image printing process for performing one page of background image recording for the next page is started (see FIG. 4).

In FIG. 4, between each step, a code for PW or LW is noted, and these mean that the wait processes described later are executed. PW is the wait process between passes that is executed between two consecutive passes, and LW is the wait process between layers that is executed between formation of two layers (specifically, the background image layer and the color image layer) (said another way, between the background image printing process and the color image printing process). Also, among the wait processes between passes, the process executed between two consecutive background image recording passes is a wait process between background image recording passes (BPW), and the process executed between two consecutive color image recording passes is the wait process between color image recording passes (CPW). Following, we will give a detailed description of those wait processes.

Wait Processes

Figure 5:
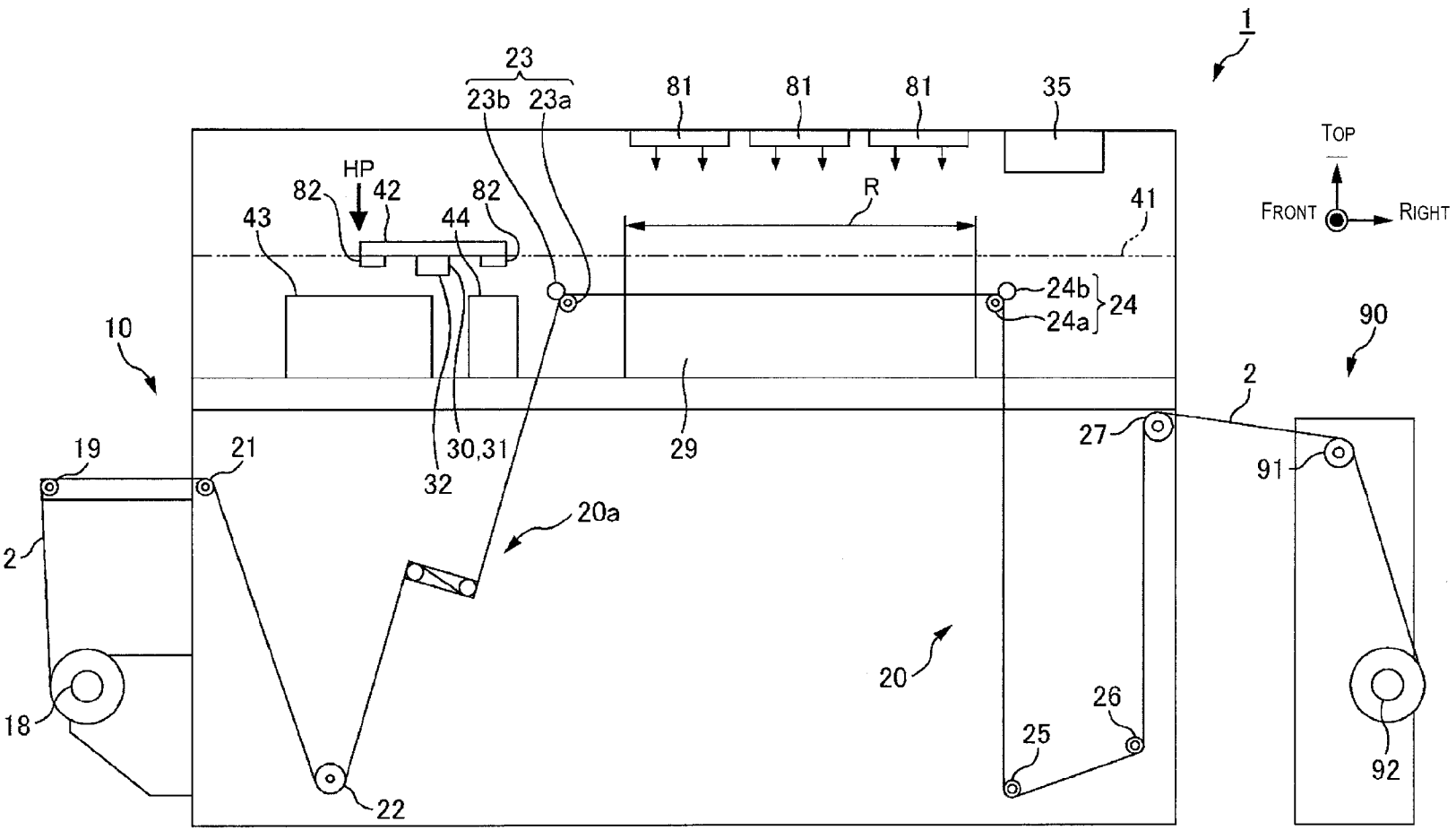
FIG. 5 is a schematic diagram showing the state of the image recording device 1 when a head 31 is positioned in the evacuation position.

Here, we will describe the wait processes using FIG. 4 and FIG. 5. FIG. 5 is a drawing corresponding to FIG. 1, and is a schematic diagram showing the state of the image recording device 1 when the head 31 is positioned in the evacuation position.

The wait process is a process by which the head 31 is moved to the evacuation position to which it was evacuated from above the platen 29 and at which the head 31 is made to wait for a designated wait time in the evacuation position between passes or between layers in order to ensure the time for sufficiently drying the ink impacted on the rolled transparent media 2 by the heat of the platen 29. As described above, as the wait processes, the wait process between passes and the wait process between layers are executed. Following, we will first describe the wait process between passes, and after that, we will describe the wait process between layers.

The wait process between passes is a process of moving the head 31 to the evacuation position to which it was evacuated from above the platen 29 and having the head 31 wait for a designated wait time at the evacuation position (hereafter called the standby process). With this embodiment, as shown in FIG. 4, while performing image recording of one page, the wait process between background image recording passes (BPW) is executed 7 times, and the wait process between color image recording passes (CPW) is executed 7 times, but each wait process between passes is the same, so following, we will describe an example of the wait process between passes between the first background image recording pass and the second background image recording pass.

As described previously, after executing the first background image recording pass (first pass background image printing) at step S1, the controller 60 executes the second background image recording pass (second pass background image printing) at step S3. However, rather than executing the second background image recording pass immediately after executing the first background image recording pass, it executes the second background image recording pass after moving the head 31 to the evacuation position and making it wait for a designated wait time after executing the first background image recording pass.

Specifically, when the controller 60 has finished executing the first background image recording pass, the head 31 is positioned above the platen 29, but the controller 60 moves the head 31 positioned at this position (hereafter referred to as the upward position) to the evacuation position evacuated away from above the platen 29. Here, the evacuation position evacuated from above the platen 29 is a position at which when the head 31 is positioned at that position, the platen 29 does not exist in the vertically downward direction of the head 31, and with this embodiment, is the position shown in FIG. 5, specifically, the position between the previously described cleaning unit 43 and the flushing unit 44. Also, the controller 60 has the head 31 wait for a designated wait time at that evacuation position. When that designated wait time has elapsed, the controller 60 moves the head 31 and positions it at (returns it to) the upward position. Then, after positioning the head 31 at the upward position, the controller 60 starts executing the second background image recording pass.

Also, as the wait process between passes, in addition to the aforementioned standby process, the controller 60 of this embodiment also executes the following two controls on the air-blowing unit 80.

First, the controller 60 increases the air speed of the ceiling fan 81 (hereafter, this is also referred to as the ceiling fan acceleration process). When executing the first background image recording pass, the controller 60 controls the ceiling fan 81 to blow air toward the rolled transparent media 2, but it controls it such that the air speed of the ceiling fan 81 at this time is a weak air speed (weak air). This is because when executing passes, if the air speed is a strong air speed (strong air), it is possible that the ink discharged by the head 31 may have flight curve occur, and that ink impact skew may occur. (In FIG. 1, it looks as if the carriage 42 blocks the air from the ceiling fan 81, but in fact, there is a gap with the carriage 42, and when the air speed is set to strong air, due to the relative positional relationship of the gap and the ceiling fan 81, the wind from that gap can cause flight curve. Also, when the air speed is set to strong air, it is possible to have a phenomenon occur of air going around from the horizontal direction to beneath the head 31.)

Also, when the controller 60 finishes executing the first background image recording pass and moves the head 31 to the evacuation position, it makes the head 31 wait and also makes the air speed of the ceiling fan 81 a strong air speed (strong air). Specifically, because the possibility of the ink not discharging and the aforementioned flight curve occurring is gone, the controller 60 blows air at a faster air speed than the air speed of the ceiling fan 81 when executing the background image recording pass. When the aforementioned designated wait time has elapsed, the controller 60 returns the air speed of the ceiling fan 81 to weak air. Then, the controller 60 starts execution of the second background image recording pass.

Second, the controller 60 stops blowing of the air by the on-carriage fan 82 (hereafter also referred to as the on-carriage fan stop process). When executing the first background image recording pass, the same as with the ceiling fan 81, the controller 60 controls the on-carriage fan 82 to blow air toward the rolled transparent media 2. This is so that the on-carriage fan 82 supplements the part of the ink drying capacity that dropped due to setting the ceiling fan 81 to weak air. The on-carriage fan 82 moves as an integrated unit with the head 31, so the air is blown in a state which always maintains a fixed distance slightly separated from the head 31 (see FIG. 5) between it and the head 31. Because of that, there is almost no occurrence of flight curve by the on-carriage fan 82.

Also, after the controller 60 finishes executing the first background image recording pass and moves the head 31 to the evacuation position, it makes the head 31 wait, and stops blowing of the air by the on-carriage fan 82. Specifically, the controller 60 stops blowing air because it is no longer in a state for which the air from the on-carriage fan 82 contacts the background image recording site of the rolled transparent media 2 due to movement of the head 31 to the evacuation position. When the previously described designated wait time has elapsed, the controller 60 starts blowing air again. Then, the controller 60 starts executing the second background image recording pass.

In this way, the wait process between passes with this embodiment is a process consisting of a standby process, a ceiling fan acceleration process, and an on-carriage fan stop process.

As described above, the wait process between passes includes a wait process between background image recording passes and a wait process between color image recording passes, and the same process is performed with the wait process between color image recording passes as with the wait process between background image recording passes. However, the wait time for the aforementioned standby processes are mutually different. Specifically, the controller 60 executes the wait process for both between the plurality of color image recording passes and the plurality of background image recording passes, but that wait process is executed such that the wait time for which the head 31 is made to wait is made to be longer with the latter than with the former. By doing this, the wait time with the wait process between the color image recording passes is shorter than the wait time with the wait process between the background image recording passes.

Next, we will describe the wait process between layers. The wait process between layers is a process by which between layers (specifically, between the background image printing process and the color image printing process), the head 31 is evacuated from above the platen 29 and moved to an evacuation position, and the head 31 is made to wait a designated wait time at the evacuation position. With this embodiment, as shown in FIG. 4, this is executed only one time while one page of image recording is performed.

As described previously, after executing the eighth background image recording pass (eighth pass of background image printing) at step S15, the controller 60 executes a first color image recording pass (first pass of color image printing) at step S17. However, rather than executing the first color image recording pass immediately after executing the eighth background image recording pass, after executing the eighth background image recording pass, the first color image recording pass is executed after executing the wait process described above.

With the wait process between layers as well, the same processes as with the wait process between passes are performed (specifically, in addition to the standby process, the ceiling fan acceleration process and the on-carriage fan stop process). However, the wait times for the standby processes are mutually different. Specifically, the controller 60 executes the wait process for both between passes and between layers, but that wait process is executed such that the wait time for which the head 31 is made to wait is longer with the latter than with the former (in specific terms, more than either between the background image recording passes or between the image recording passes). By doing this, the wait time for the wait process between layers is longer than the wait time for the wait process between passes.

Surface Printing and Back Surface Printing

With the example of the image recording operation described previously using FIG. 4, the controller 60 first performed the background image printing process, and subsequent to that background image printing process, performed the color image printing process. However, as shown in FIG. 6, the controller 60 can also reverse both procedures, specifically, first perform the color image printing process, and subsequent to that color image printing process, perform the background image printing process.

Figure 6:
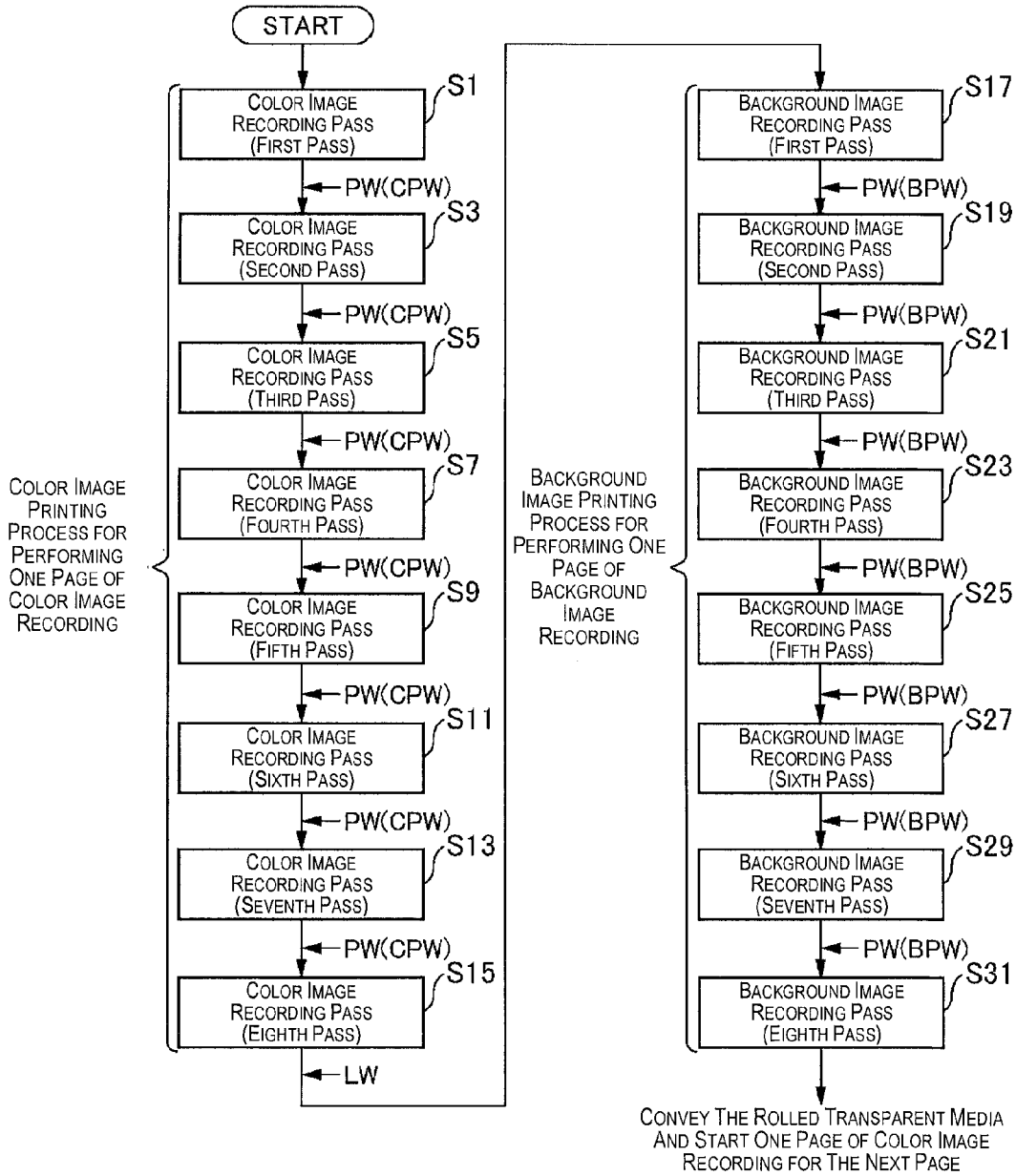
FIG. 6 is an explanatory diagram for describing another example of the image recording operation of the image recording device 1.

Typically, printing by the procedure shown in FIG. 4 and printing by the procedure shown in FIG. 6 are respectively called surface printing and back surface printing. Also, with the image recording device 1 of this embodiment, both printings can be performed. In other words, the controller 60 of this embodiment selectively executes the surface printing process by which the background image printing process is performed, and the color image printing process is performed subsequent to that background image printing process, and the back surface printing process by which the color image printing process is performed, and the background image printing process is performed subsequent to that color image printing process.

Then, as shown in FIG. 6, with the back surface printing process as well, the same as with the surface printing process, while performing one page of image recording, the wait process between color image recording passes is executed 7 times, the wait process between background image recording passes is executed 7 times, and the wait process between layers is executed one time, and with each of the wait processes, the standby process, the ceiling fan acceleration process, and the on-carriage fan stop process are performed. However, with the back surface printing process and the surface printing process, there are the following differences regarding the wait time of the standby process.

First, the controller 60 executes the wait process for both between the plurality of background image record passes with the surface printing process, and between the plurality of background image recording passes with the back surface printing process, but that wait process is executed such that the wait time for which the head 31 is made to wait is longer with the former than with the latter. By doing this, the wait time with the wait process between the background image recording passes with the surface printing process is longer than the wait time with the wait process between the background image recording passes with the back surface printing process.

Second, the controller 60 executes the wait process for both between the background image printing process and the color image printing process with the surface printing process, and between the color image printing process and the background image printing process with the back surface printing process, but that wait process is executed such that the wait time for which the head 31 is made to wait is longer with the former than with the latter. By doing this, the wait time with the wait process between layers with the surface printing process is longer than the wait time with the wait process between layers with the back surface printing process.

Figures 7, 8:
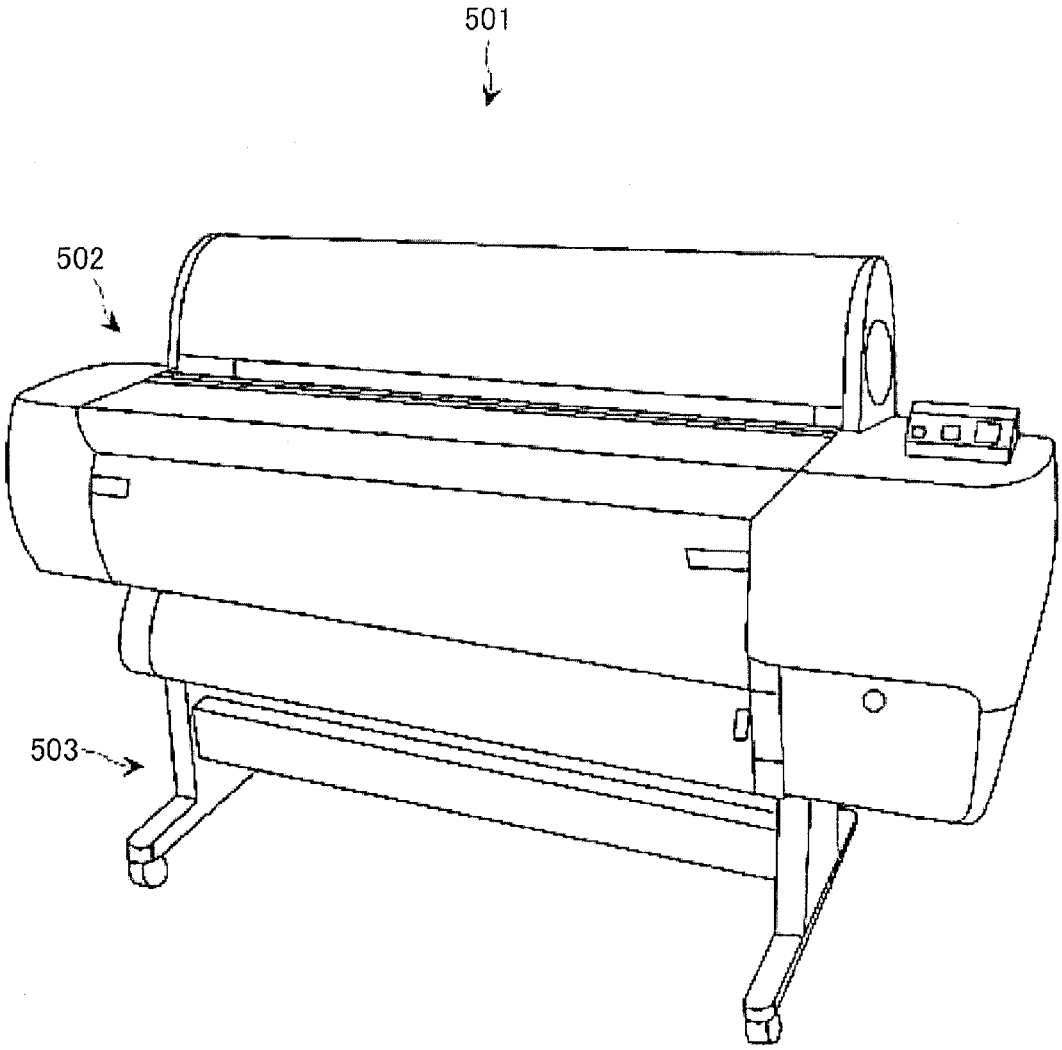
FIG. 7 is a drawing showing the wait time with the standby process.
FIG. 8 is an external view pattern diagram of an inkjet printer 501.

FIG. 7 summarizes the relationship of the wait times described up to now in a table. In the table, T1 to T5 represent times, and T1<T2<T3<T4<T5. With this embodiment, T1, T2, T3, T4, and T5 are set respectively to 1 second, 1.3 seconds, 1.5 seconds, 3 seconds, and 4 seconds.

Effectiveness of Image Recording Device 1 of this Embodiment

As described above, the image recording device 1 of this embodiment has the platen 29 that supports and heats the rolled transparent media 2, the head 31 that discharges color image ink and background image ink on the rolled transparent media 2 supported by the platen 29, and the controller 60 that performs the color image printing process for printing a color image on the rolled transparent media 2 by executing a plurality of times the color image recording pass of having the head 31 discharge color image ink while moving the head 31 in the conveyance direction relative to the rolled transparent media 2, changing the relative position of the head 31 to the rolled transparent media 2 in the row direction intersecting with the conveyance direction, and the background image printing process for printing the background image which will be the background of the color image on the rolled transparent media 2 by executing a plurality of times the background image recording pass of having the head 31 discharge background image ink while moving the head 31 in the conveyance direction relative to the rolled transparent media 2, changing the relative position of the head 31 to the rolled transparent media 2 in the row direction intersecting with the conveyance direction. Then, that controller 60 executes a wait process by which for at least one of between the plurality of times of the color image recording passes and between the plurality of times of the background image recording passes, the head 31 is evacuated from above the platen 29 and moved to the evacuation position, and the head 31 is made to wait at that evacuation position. Specifically, the controller 60 executes the wait process between passes which is provided with a standby process. Then, by doing this, it becomes possible to inhibit degradation of the image quality.

With the image recording device 1 of a comparison example, this kind of wait process between passes was not executed, so the following problems occurred.

Specifically, a phenomenon occurred of mixing and bleeding of the ink of mutually adjacent raster lines formed by two consecutive image recording passes (for example, the ink of raster line L1 formed by the first background image recording pass and the ink of raster line L2 formed by the second background image recording pass). In other words, before there was time for the ink of the raster line L1 formed by the first background image recording pass to dry, the raster line L2 was formed by the second background image recording pass, which led to the occurrence of this kind of phenomenon.

Also, in a case when the image resolution is high, a portion of the ink of the raster line L2 formed by the second background image recording pass overlaps the ink of the raster line L1 formed by the first background image recording pass, but at that time, the ink of the raster line L2 covers over the ink of the raster line L1 which has not sufficiently dried, and the ink of the raster line L2 acts as a film. Because of that, drying of the ink of the raster line L1 formed by the first background image recording pass is notably hindered by the ink of the raster line L2 formed by the second background image recording pass which has become a film. Then, as the raster lines from the raster line L3 formed by the third background image recording pass and thereafter overlap in sequence, drying of the ink is hindered for the same reasons for these raster lines as well.

Then, when the raster line L1 is next formed by the first color image recording pass, the ink of that raster line L1 acts as a film as well, but on the other hand, the ink of that raster line L1 (specifically, the color ink) travels on the ink of the raster line formed by a background image recording pass which has not sufficiently dried (specifically, white ink), and a phenomenon of moving downward (this kind of phenomenon is called subduction) occurs. Then, when there is marked occurrence of this phenomenon, there are cases when color ink reaches as far as the back side of the white ink. In this way, when doing surface printing, the color ink is subducted into the white ink (solid white image) (in some cases, as far as the back side). Also, in the case of back surface printing, the white ink is subducted into the color ink (color image) (in some cases, as far as the back side).

In contrast to this, with the image recording device 1 of this embodiment, because the wait process between passes is executed, it is possible to ensure sufficient time for drying between passes by the heat of the platen 29 for the ink that has impacted on the rolled transparent media 2. Because of that, the raster line next after a given raster line is formed after the ink of each raster line is sufficiently dried. Because of that, the occurrence of the bleeding and subduction described above is suppressed.

Furthermore, with the wait process between passes, the head 31 is moved to the evacuation position and the head 31 is made to wait at the evacuation position, so it is possible to suppress the occurrence of clogging of the ink discharge nozzles. Specifically, if by chance the head 31 is not moved to the evacuation position and is positioned as is above the platen 29, the ink viscosity will change and become an unsuitable value. Then, ink discharge nozzle clogging occurs because of that. With this embodiment, the head 31 is moved to the evacuation position and the head 31 is made to wait at the evacuation position, so it is possible to suppress the occurrence of that clogging.

In this way, with this embodiment, the occurrence of bleeding, subduction, and clogging is suppressed, and degradation of the image quality is inhibited.

Other Embodiments

The embodiment noted above was mainly noted regarding the printing device, but it also includes disclosure of a printing method and the like. Also, the embodiment noted above is for making the present invention easier to understand, and is not to be interpreted as limiting the present invention. It goes without saying that the present invention can be modified or reformed without straying from its gist, and that equivalent items thereof are included in the present invention. In particular, the embodiments described hereafter are also included in the present invention.

Also, we described the embodiment noted above using an example of the rolled transparent media 2 as the media, but the invention is not limited to this, and for example can also be cut media, or can be media that is not transparent.

Also, with the embodiment noted above, the controller 60 executed the wait process between passes for both between the plurality of color image recording passes and between the plurality of background image recording passes, but the invention is not limited to this. As long as the wait process between passes is executed for at least one of between the plurality of color image recording passes and between the plurality of background image recording passes, it is possible to obtain the effect described above, specifically, the effect of inhibiting the degradation of the image quality. For example, it is acceptable to execute the wait process between passes for only the latter of between the plurality of color image recording passes and between the plurality of background image recording passes.

To print the background image, to ensure the shielding properties (the background image covering the rolled transparent media 2 without a gap, in other words, not being transparent when the background image is seen), compared to the color image, it is necessary to discharge a larger volume of ink (in other words, the ink application volume is higher). Because of that, there is a tendency for the background image ink to have more difficulty drying than the color image ink.

Therefore, if the wait process between passes is performed only between background image recording passes, while the countermeasure for inhibiting degradation of the image quality is reliably achieved for the background image which is relatively difficult to dry, for the color image which dries comparatively easily, the focus is placed on increasing the printing speed, and the wait process between passes is omitted. Because of that, it is possible to increase the printing speed while inhibiting degradation of image quality.

Also, with the embodiment noted above, the wait process between passes was executed between all the background image recording passes (in FIG. 4 and FIG. 6, between 7 passes), but the invention is not limited to this, and it is also possible to execute the wait process between passes between a portion of the background image recording passes. Also the wait process between passes was executed between all the color image recording passes (in FIG. 4 and FIG. 6, between 7 passes), but the invention is not limited to this, and it is also possible to execute the wait process between passes between a portion of the color image recording passes.

Also, with the embodiment noted above, when executing the color image recording pass and the background image recording pass, the controller 60 controlled the ceiling fan 81 to blow air toward the rolled transparent media 2, and the wait process between passes was a process with which the head 31 is evacuated from above the platen 29 and moved to the evacuation position, the head 31 is made to wait at the evacuation position, and blowing of the air is performed at a faster air speed than the air speed of the ceiling fan 81 when executing the color image recording passes and the background image recording passes. Specifically, the wait process between passes was provided with a standby process and a ceiling fan acceleration process, but the invention is not limited to this, and for example it is also possible to not provide a ceiling fan acceleration process.

However, by providing the ceiling fan acceleration process, it is possible to more suitably dry the ink that has impacted on the rolled transparent media 2 between passes, and the embodiment noted above is preferable in terms of being able to more suitably inhibit degradation of the image quality.

Also, with the embodiment noted above, when executing the color image recording passes and the background image recording passes, the controller 60 controlled the ceiling fan 81 and the on-carriage fan 82 to blow air toward the rolled transparent media 2, and the wait process between passes is a process with which the head 31 is evacuated from above the platen 29 and moved to the evacuation position, the head 31 is made to wait at the evacuation position, and while blowing of the air by the ceiling fan 81 is performed at a faster air speed than the air speed of the ceiling fan 81 when executing the color image recording passes and the background image recording passes, blowing of the air by the on-carriage fan 82 is stopped. Specifically, the wait process between passes was provided with the standby process, the ceiling fan acceleration process, and the on-carriage fan stop process, but the invention is not limited to this, and for example it is also possible to not provide the on-carriage fan stop process.

However, the embodiment noted above is preferable because it is possible to save power by providing the on-carriage fan stop process.

Also, as shown in FIG. 5, with the embodiment noted above, when the head 31 is made to wait at the evacuation position, the two on-carriage fans 82 are respectively positioned on the cleaning unit 43 and on the flushing unit 44 (said another way, the cleaning unit 43 and the flushing unit 44 are positioned in the air progression direction from the on-carriage fan 82). Then, in this state, if the operation is done such that the on-carriage fan 82 is not stopped, then blowing of the air is performed toward the cleaning unit 43 and the flushing unit 44, and the problem occurs of the ink inside the cleaning unit 43 and the flushing unit 44 drying and becoming adhered to the unit. With the embodiment noted above, the on-carriage fan stop process is provided, so it is possible to stop the occurrence of that problem, and that is another reason that the embodiment noted above is preferable.

Also, with the embodiment noted above, for both between the plurality of color image recording passes and between the plurality of background image recording passes, the controller 60 was made to execute the wait process between passes such that the wait time for which the head 31 is made to wait is longer with the latter than with the former, but the invention is not limited to this. For example, the wait process between passes can also be executed such that the wait time of the wait process between passes is the same between the color image recording passes and between the background image recording passes.

As described above, to print the background image, to ensure the shielding properties, it is necessary to discharge a larger volume of ink than with the color image. Because of that, there is a tendency for the background image ink to be more difficult to dry than the color image ink. Therefore, if the wait time of the wait process between the background image recording passes is made to be longer than the wait time of the wait process between the color image recording passes, while it is possible to reliably achieve a countermeasure for inhibiting image quality degradation for the background image which is relatively more difficult to dry, it is possible to focus on increasing the printing speed for the color image which dries relatively easily, and to shorten the wait process between processes. Because of that, it is possible to increase the printing speed while inhibiting degradation of the image quality, and that point makes the embodiment noted above preferable.

Also, with the embodiment noted above, for both between the plurality of background image recording passes with the surface printing process and between the plurality of background image recording passes with the back surface printing process, the controller 60 was made to execute the wait process between passes such that the wait time that the head 31 is made to wait is longer with the former than the latter, but the invention is not limited to this. For example, it is also possible to execute the wait process between passes such that the wait time of the wait process between the background image recording passes is the same for the surface printing process and the back surface printing process.

With the surface printing, first the background image printing process is performed, and subsequent to that background image printing process, the color image printing process is performed (the color image overlaps immediately above the background image), so there is great significance to sufficiently drying the background image using the wait process between passes. In contrast to this, with the back surface printing, first the color image printing process is performed, and subsequent to that color image printing process, the background image printing process is performed (the background image is overlapped on the color image, in other words, there is no image overlapping the background image), so compared to the surface printing case, the aforementioned significance is not as great.

Therefore, if the wait time of the wait process between the background image recording passes with the surface printing process is made to be longer than the wait time of the wait process between the background image recording passes with the back surface printing process, while it is possible to reliably achieve the countermeasure for inhibiting degradation of the image quality for the background image of the surface printing which is of great significance, for the background image of the back surface printing for which that significance is not comparatively as great, the focus is placed on increasing the printing speed, and the wait process between passes is shortened. Because of that, it is possible to increase the printing speed while inhibiting the degradation of the image quality, and this point makes the embodiment noted above preferable.

Also, with the embodiment noted above, we described an example of a lateral scan type label printing apparatus as the printing device, but the invention is not limited to this, and for example it is also possible to use a serial scan type large format printer.

Figure 9:
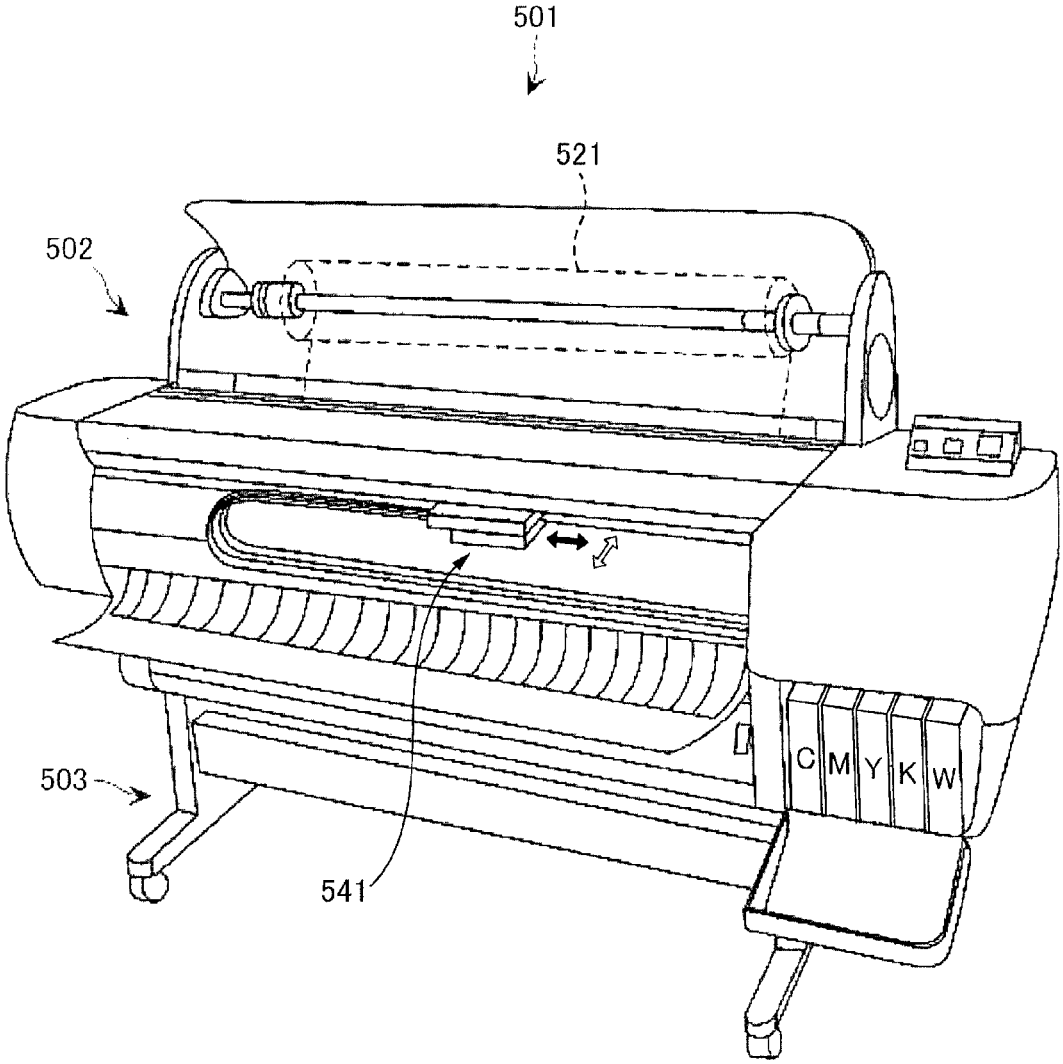
FIG. 9 is a schematic diagram showing the constitution of the inkjet printer 501.

Following, we will describe that serial scan type large format printer (hereafter called the inkjet printer 501) using FIG. 8 and FIG. 9. FIG. 8 is an external view schematic drawing showing the inkjet printer 501. FIG. 9 is a schematic drawing showing the constitution of the inkjet printer 501.

As shown in FIG. 8 and FIG. 9, the inkjet printer 501 is equipped with a printer main unit 502 and a support stand 503 for supporting the printer main unit 502. This inkjet printer 501 is equipped with a platen (not illustrated) that supports and heats the rolled transparent media 521, an inkjet head 541 that discharges color image ink and background image ink on the rolled transparent media 521 supported by the platen, and a controller. Then, for this inkjet printer 501 as well, the previously described background image printing process and the color image printing process are executed by the controller.

To describe an example of the surface printing process, the controller first executes a plurality of times the background image recording pass by which the inkjet head 541 is made to discharge background image ink while moving the inkjet head 541 in the movement direction (in FIG. 9, the direction shown by the thick black arrow) relative to the rolled transparent media 521, changing the relative position of the inkjet head 541 in relation to the rolled transparent media 521 in the intersecting direction intersecting with the movement direction (in FIG. 9, the direction shown by the thick white arrow), and executes the background image printing process by which the background image which is the background for the color image is printed on the rolled transparent media 521.

Here, the same as with the label printing apparatus described above, the controller executes the background image recording pass by having the inkjet head 541 discharge background image ink while moving the inkjet head 541 in the movement direction in relation to the rolled transparent media 521. However, with the label printing apparatus, when executing that background image recording pass a plurality of times changing the relative position of the inkjet head 541 in relation to the rolled transparent media 521 in the intersecting direction, that relative position was changed by moving the inkjet head 541 in the intersecting direction, and in contrast to that, with the inkjet printer 501, at that time, that relative position is changed by moving the rolled transparent media 521 in the intersecting direction. In other words, with the inkjet printer 501, in contrast to the label printing apparatus, the controller executes the background image printing process while sending the rolled transparent media 521 in the conveyance direction (specifically, the intersecting direction).

After finishing the execution of the background image printing process, the controller subsequently executes the color image printing process, but before executing the color image printing process, it does back feeding of the rolled transparent media 521 by the conveyance amount of the portion sent with the background image printing process.

Next, the controller executes the color image printing process for printing the color image on the rolled transparent media 521 by executing a plurality of times the color image recording pass by which the inkjet head 541 is made to discharge color image ink while moving the inkjet head 541 in the movement direction (in FIG. 9, the direction shown by the thick black arrow) relative to the rolled transparent media 521, changing the relative position of the inkjet head 541 to the rolled transparent media 521 in the intersecting direction that intersects the movement direction (in FIG. 9, the direction shown by the thick white arrow).

In that case as well, when the controller executes a plurality of times the color image recording pass by having the inkjet head 541 discharge color image ink while moving the inkjet head 541 in the movement direction in relation to the rolled transparent media 521, changing the relative position of the inkjet head 541 in relation to the rolled transparent media 521 in the intersecting direction of that color image recording pass, it changes that relative position by moving the rolled transparent media 521 in the intersecting direction.

Then, it is also possible to perform the wait process between passes provided with the standby process described above between background image recording passes and between the color image recording passes of this kind of background image printing process and color image printing process.

It is also possible to provide a ceiling fan and on-carriage fan on the inkjet printer 501 shown in FIG. 8 and FIG. 9, and to execute the previously described ceiling fan acceleration process and the on-carrier fan stop process with the wait process between passes.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing device comprising:

a support and heating unit configured and arranged to support and heat a medium;

a head configured and arranged to discharge color image ink and background image ink on the medium supported by the support and heating unit; and a controller configured to perform a color image printing process for printing a color image on the medium by executing a plurality color image recording passes with which the head is made to discharge the color image ink while the head is moved relative to the medium in a movement direction, the color image recording passes being executed with different relative positions of the head with respect to the medium in an intersecting direction that intersects with the movement direction, a background image printing process for printing a background image that is a background for the color image on the medium by executing a plurality of background image recording passes with which the head is made to discharge the background image ink while the head is moved relative to the medium in the movement direction, the background image recording passes being executed with different relative positions of the head with respect to the medium in the intersecting direction that intersects with the movement direction, and a wait process of evacuating the head from above the support and heating unit and moving the head to an evacuation position to have the head wait at the evacuation position during at least one of between the color image recording passes and between the background image recording passes.

2. The printing device according to claim 1, further comprising an air blower configured and arranged to blow air toward the medium, wherein when executing the color image recording passes and the background image recording passes, the controller is configured to control the air blower to blow air toward the medium, and when executing the wait process, the controller is further configured to control the air blower so that the air is blown at a faster speed than a speed when executing the color image recording passes and the background image recording passes.

3. The printing device according to claim 2, further comprising a carriage supporting the head, and configured and arranged to move along with a movement of the head, and a moving air blower provided on the carriage, and configured and arranged to blow air toward the medium while moving along with the movement of the head, wherein the air blower is a fixed air blower fixed to a printing device main unit, when executing the color image recording passes and the background image recording passes, the controller is configured to control the fixed air blower and the moving air blower to blow air toward the medium, and when executing the wait process, the controller is further configured to control the fixed air blower so that the air is blown at a faster speed than a speed when executing the color image recording passes and the background image recording passes, and to stop blowing of the air from the moving air blower.

4. The printing device according to claim 1, wherein the controller is configured to execute the wait process only between the background image recording passes.

5. The printing device according to claim 1, wherein the controller is configured to execute the wait process both between the color image recording passes and between the background image recording passes such that a wait time for which the head is made to wait is longer between the background image recording passes than between the color image recording passes.

6. The printing device according to claim 1, wherein the controller is configured to selectively execute a surface printing process in which the background image printing process is performed and the color image printing process is performed subsequent to the background image printing process, and a back surface printing process in which the color image printing process is performed and the background image printing process is performed subsequent to the color image printing process, and execute the wait process both between the background image recording passes with the surface printing process and between the background image recording passes with the back surface printing process, so that a wait time for which the head is made to wait is longer between the background image recording passes with the surface printing process than between the background image recording passes with the back surface printing process.

7. A printing method comprising:

printing a color image on a medium by executing a plurality color image recording passes with which a head is made to discharge color image ink and background image ink on a medium supported and heated by a support and heating unit while the head is moved relative to the medium in a movement direction, the color image recording passes being executed with different relative positions of the head with respect to the medium in an intersecting direction that intersects with the movement direction;

printing a background image that is a background for the color image on the medium by executing a plurality background image recording passes with which the head is made to discharge background image ink while the head is moved relative to the medium in the movement direction, the background image recording passes being executed with different relative positions of the head with respect to the medium in the intersecting direction that intersects with the movement direction; and executing a wait process in which the head is evacuated from above the support and heating unit and moved to an evacuation position so that the head is made to wait at the evacuation position at least one of between the color image recording passes and between the background image recording passes.

* * * * *